US007506599B2

(12) United States Patent
Mizutani

(10) Patent No.: US 7,506,599 B2
(45) Date of Patent: Mar. 24, 2009

(54) BOAT STEERING SYSTEM

(75) Inventor: Makoto Mizutani, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/853,731

(22) Filed: Sep. 11, 2007

(65) Prior Publication Data

US 2008/0108256 A1 May 8, 2008

(30) Foreign Application Priority Data

Sep. 11, 2006 (JP) ..... 2006-245970
Nov. 22, 2006 (JP) ..... 2006-315303

(51) Int. Cl.
*B63H 25/00* (2006.01)

(52) U.S. Cl. ..... 114/144 R; 114/144 RE; 440/1

(58) Field of Classification Search ..... 114/144 E, 114/144 R, 144 RE; 180/446; 440/1
See application file for complete search history.

(56) References Cited

U.S. PATENT DOCUMENTS 4,716,983 A * 1/1988 Adams et al. ..... 180/446
4,907,668 A * 3/1990 Onishi et al. ..... 180/443
5,244,426 A * 9/1993 Miyashita et al. ..... 114/144 R
7,097,520 B2 * 8/2006 Okumura et al. ..... 440/1

FOREIGN PATENT DOCUMENTS

JP 04-038297 2/1992
JP 2959044 7/1999
JP 2005-254848 9/2005
JP 2006-069408 3/2006

OTHER PUBLICATIONS

U.S. Appl. No. 11/859,544, filed Sep. 21, 2007, entitled Watercraft Steering System.
U.S. Appl. No. 11/859,654, filed Sep. 21, 2007, entitled Watercraft Steering System.
U.S. Appl. No. 11/859,533, filed Sep. 21, 2007, entitled Watercraft Steering System.
U.S. Appl. No. 11/781,785, filed Jul. 23, 2007, entitled Steering System for Outboard Motor.

* cited by examiner

*Primary Examiner*—Lars A Olson
(74) *Attorney, Agent, or Firm*—Knobbe, Martens, Olson & Bear, LLP

(57) ABSTRACT

An outboard motor is provided on a hull and a steering system is connected electrically to the outboard motor and adapted to steer the hull by rotating the outboard motor. Steering motors are provided to the outboard motor. A control unit has a motor selector for choosing which of the steering motors is used to steer the outboard motor. The control unit stores motor characteristic data about the steering motors and correction data based on factors that change characteristics of the steering motors. The motor selector compares a detection signal of a steering torque detector of a boat with the motor characteristic data and the correction data in order to select at least one of the steering motors to be operated.

20 Claims, 14 Drawing Sheets

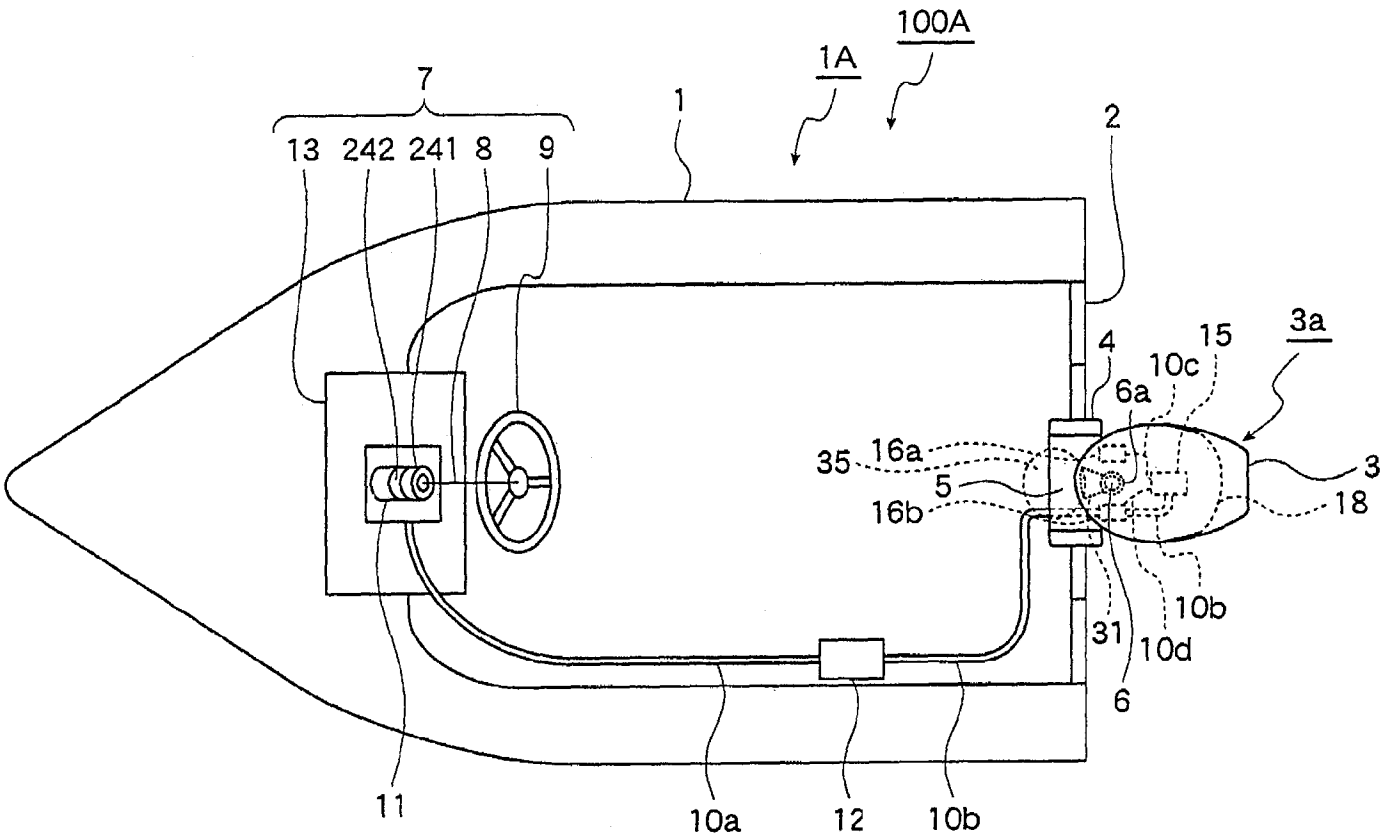
[FIG. 1]

[FIG. 2]
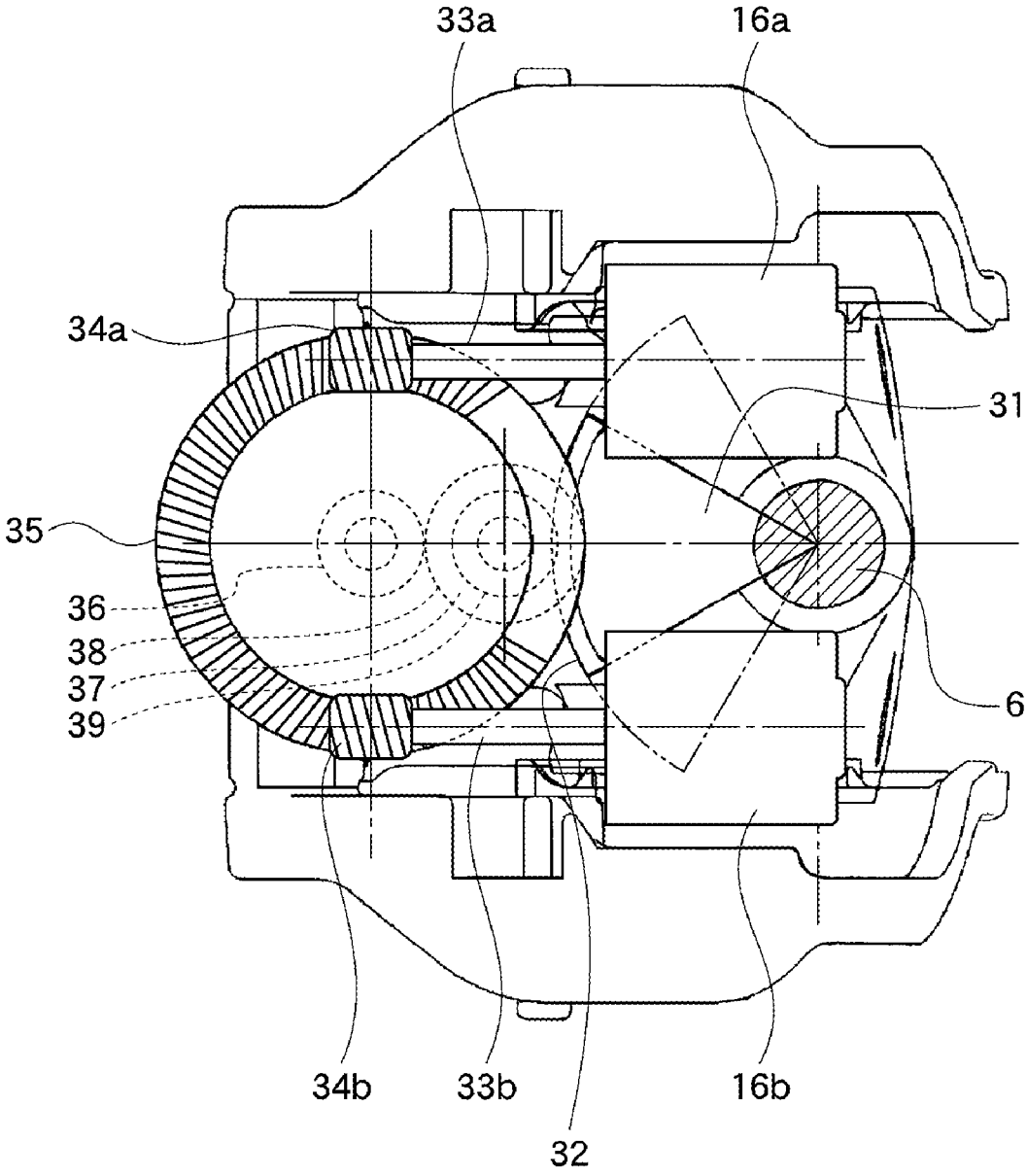

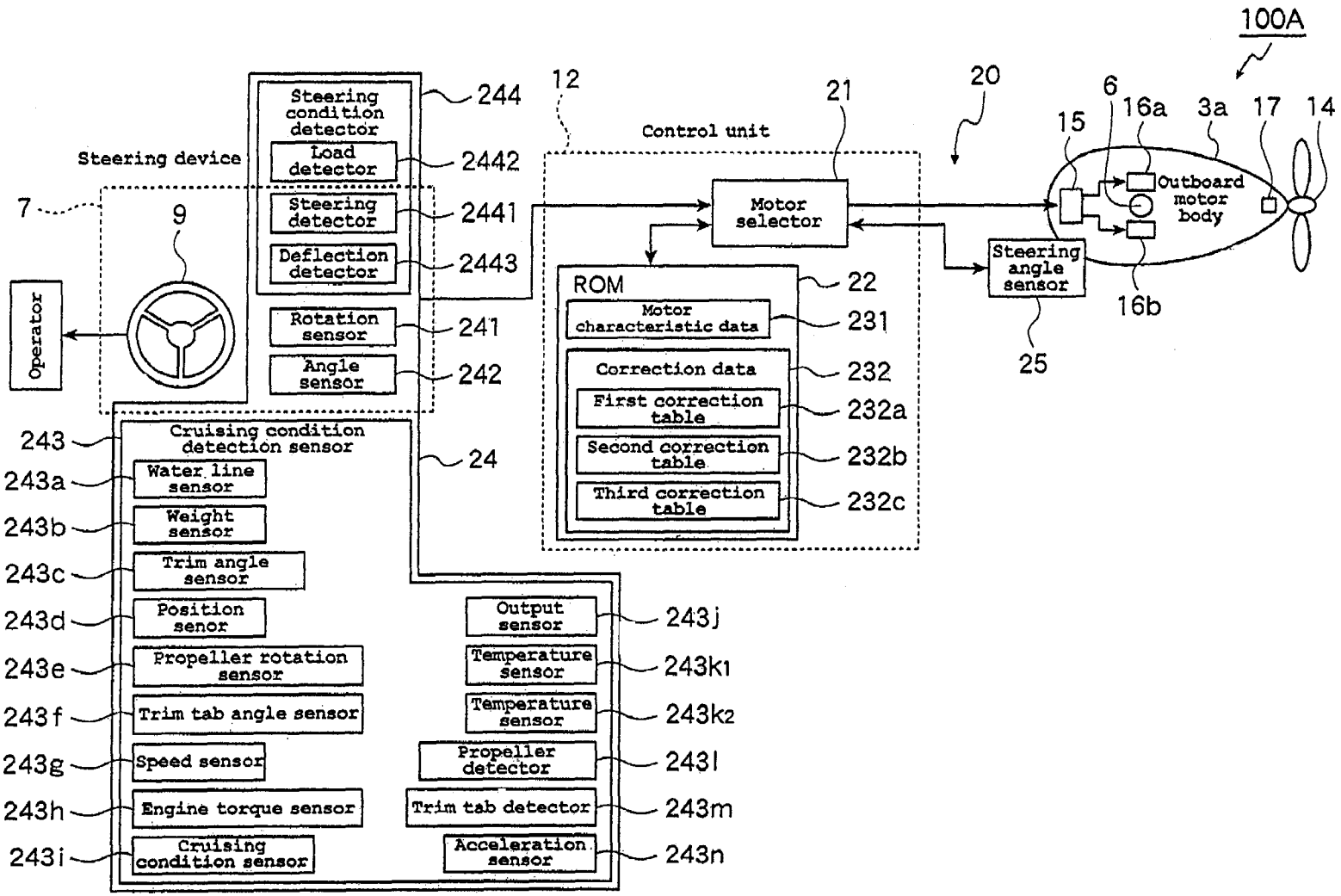
[FIG. 3]

[FIG. 4]

(a)

| Torque (mN-m) | 0.00 | 49.00 | 98.00 | 147.00 | 196.00 | 245.00 | 294.00 |
|---|---|---|---|---|---|---|---|
| Motor efficiency (%) | 0.00 | 25.0 | 35.0 | 40.0 | 42.0 | 43.0 | 43.5 |
| Torque (mN-m) | 343.00 | 392.00 | 441.00 | 490.00 | 539.00 | 588.00 | 637.00 |
| Motor efficiency (%) | 43.0 | 42.0 | 41.0 | 40.0 | 38.8 | 37.0 | 36.0 |

231

(b)

| Steering angle (deg) / Steering direction, correction value | +30~ +21 | +20~ +11 | +10~ 0 | 0~ −10 | −11~ −20 | −20~ −30 |
|---|---|---|---|---|---|---|
| Right (+) | 4 | 3 | 2 | 1 | 0 | −1 |
| Left (−) | 1 | 0 | −1 | −2 | −3 | −4 |

232a (c)

| Steering speed (deg/s) | +15~ +11 | +10~ +6 | +5~ 0 | 0~ −5 | −6~ −10 | −11~ −15 |
|---|---|---|---|---|---|---|
| Correction value | 3 | 2 | 1 | 1 | 2 | 3 |

232b (d)

| Boat load (kg) | 0~ 200 | 201~ 400 | 401~ 600 | 601~ 800 | 801~ 1000 | 1001~ 1200 |
|---|---|---|---|---|---|---|
| Correction value | 0 | 1 | 2 | 3 | 4 | 5 |

232c (e)

| Motor temperature (℃) | 0~ 20 | 21~ 40 | 41~ 60 | 61~ 80 | 81~ 100 | 101~ 120 |
|---|---|---|---|---|---|---|
| Correction value | 1 | 0.95 | 0.9 | 0.85 | 0.8 | 0.75 |

232

[FIG. 5]
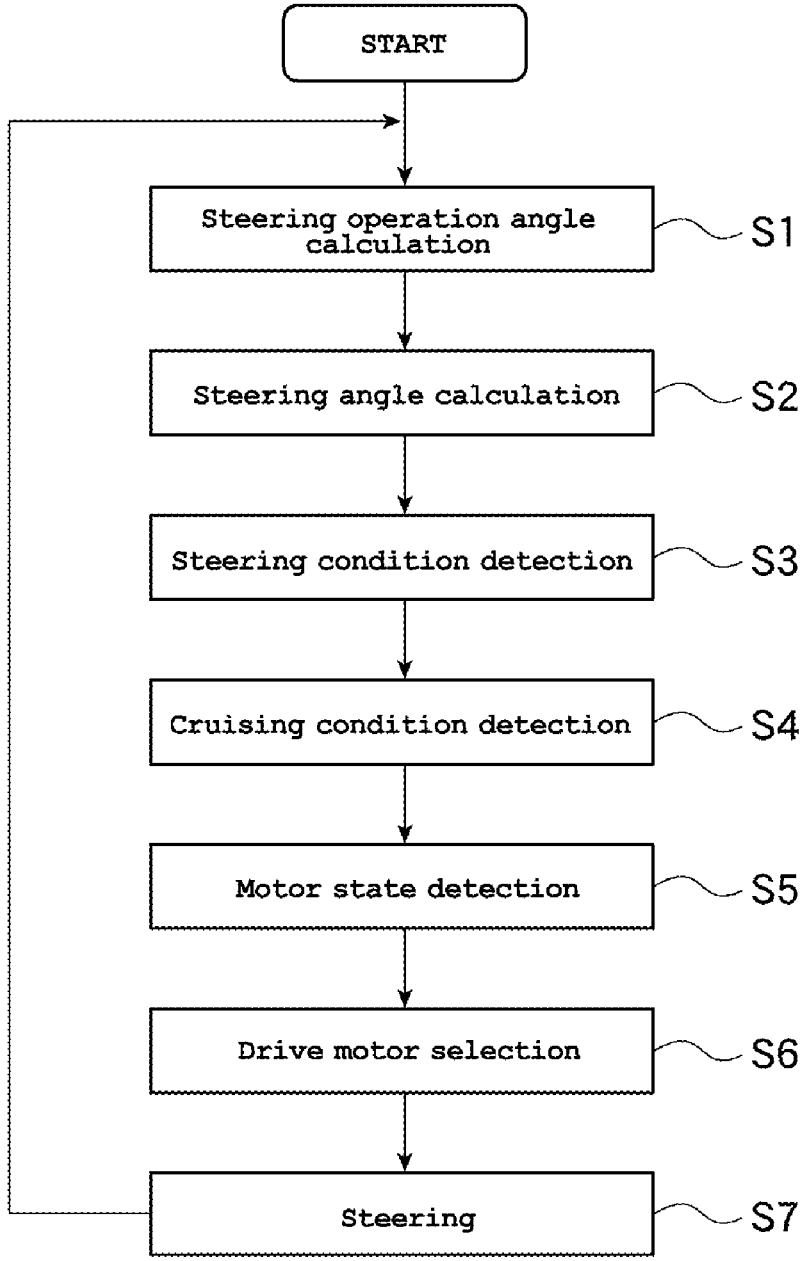

[FIG. 6]
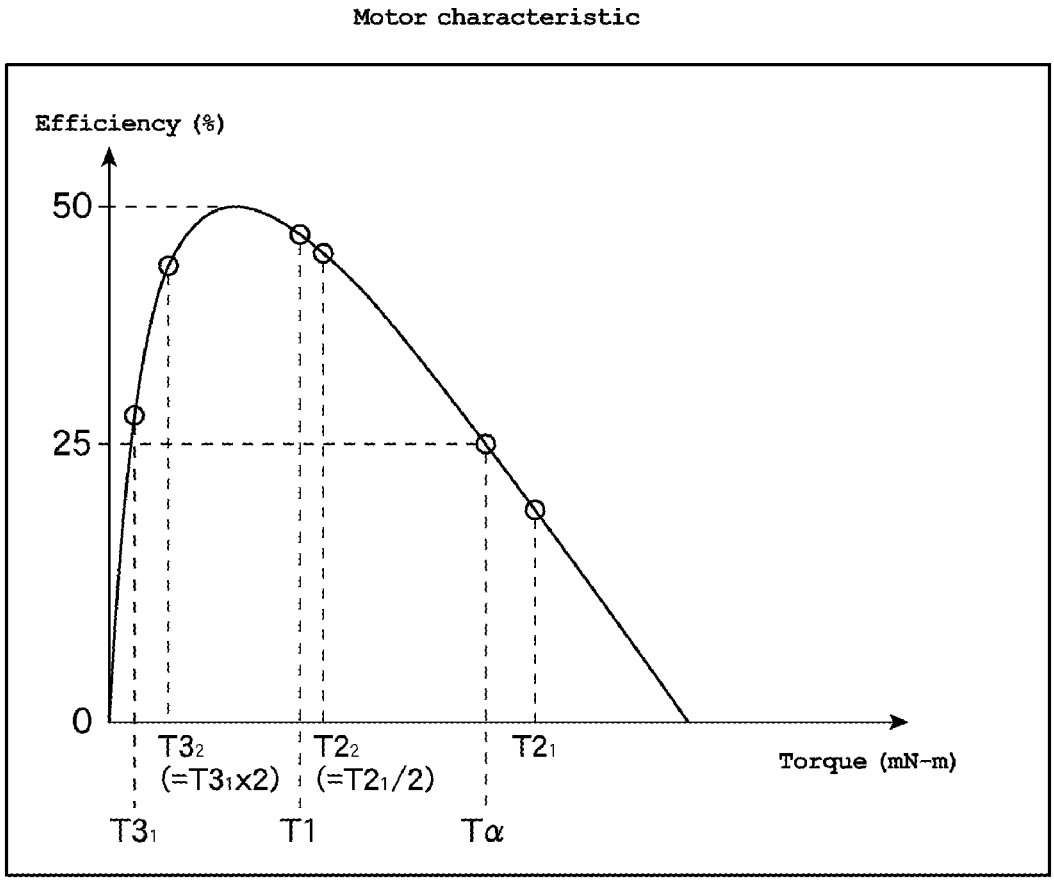

[FIG. 7]
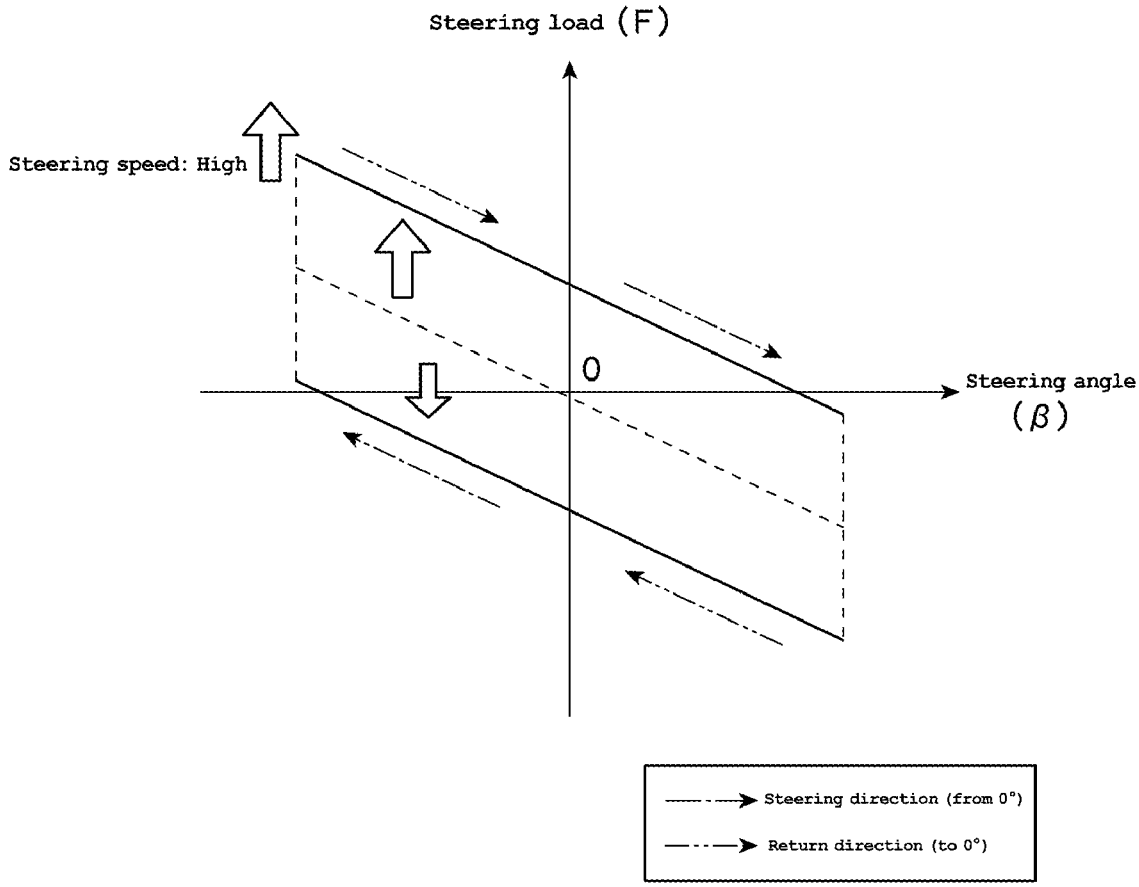

[FIG. 8A]
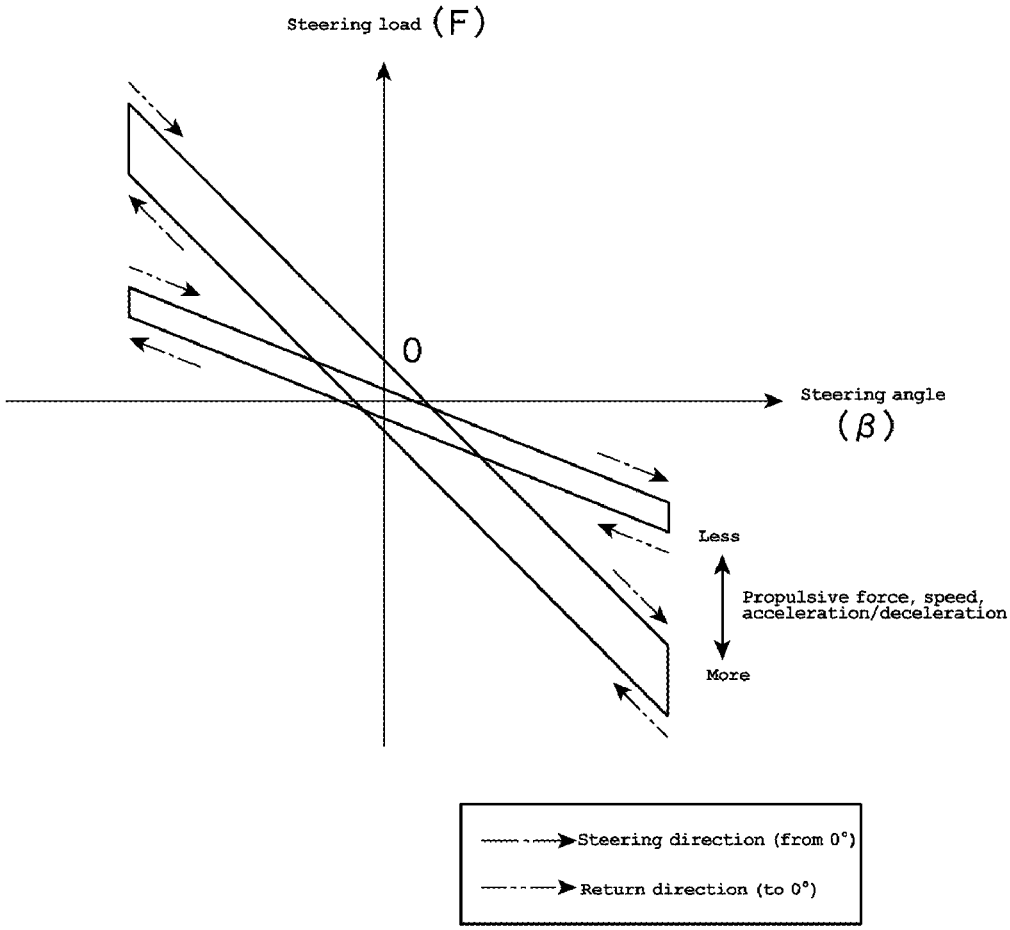

[FIG. 8B]
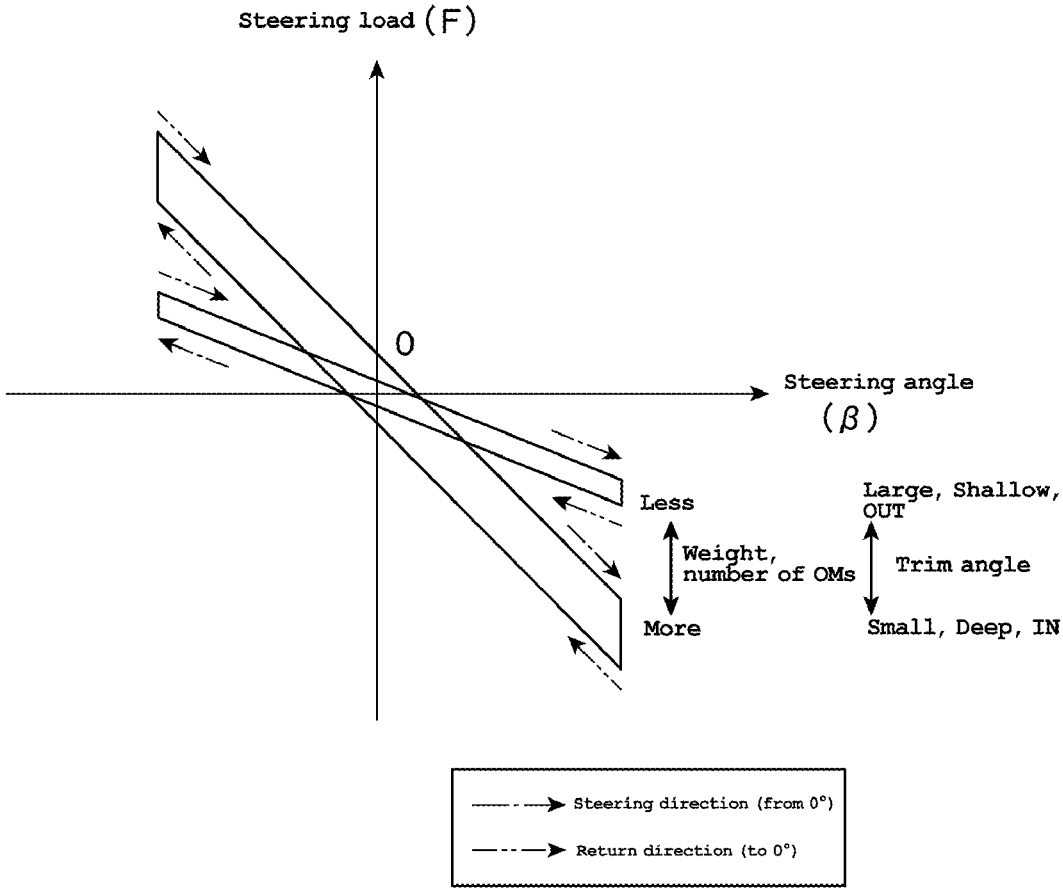

[FIG. 8C]
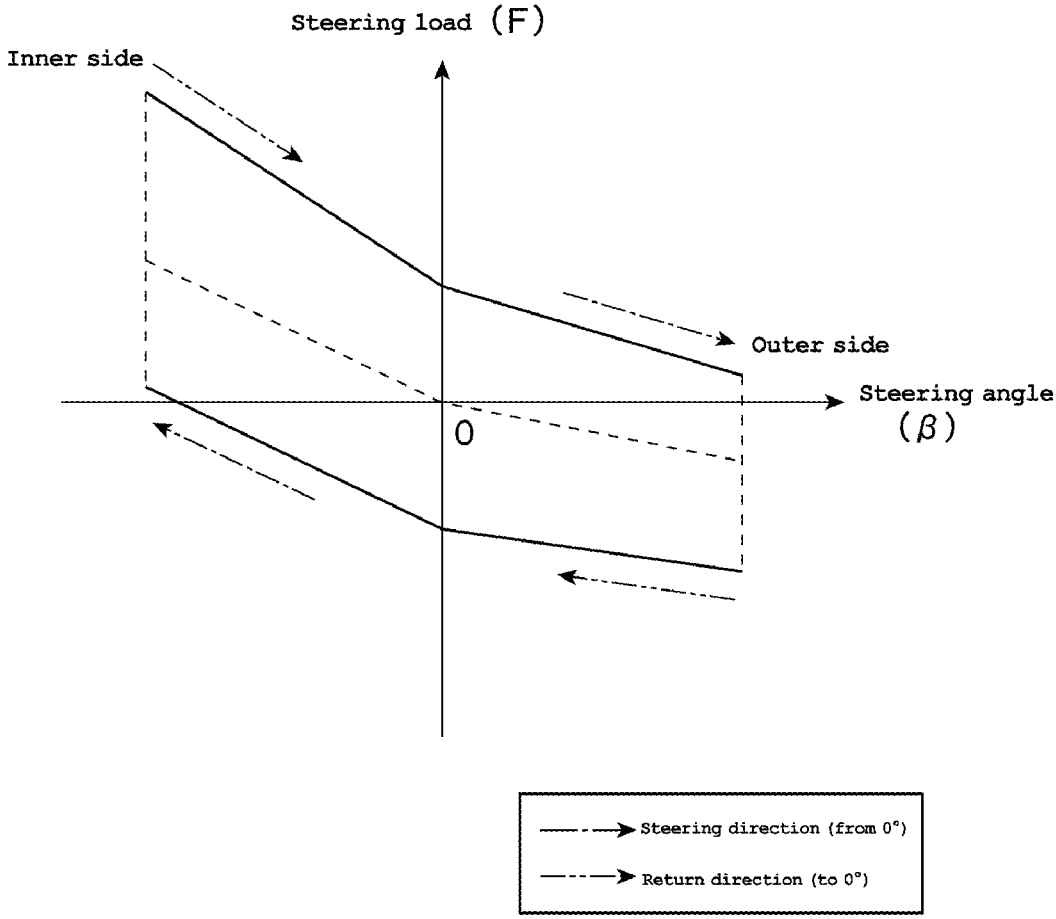

[FIG. 9]
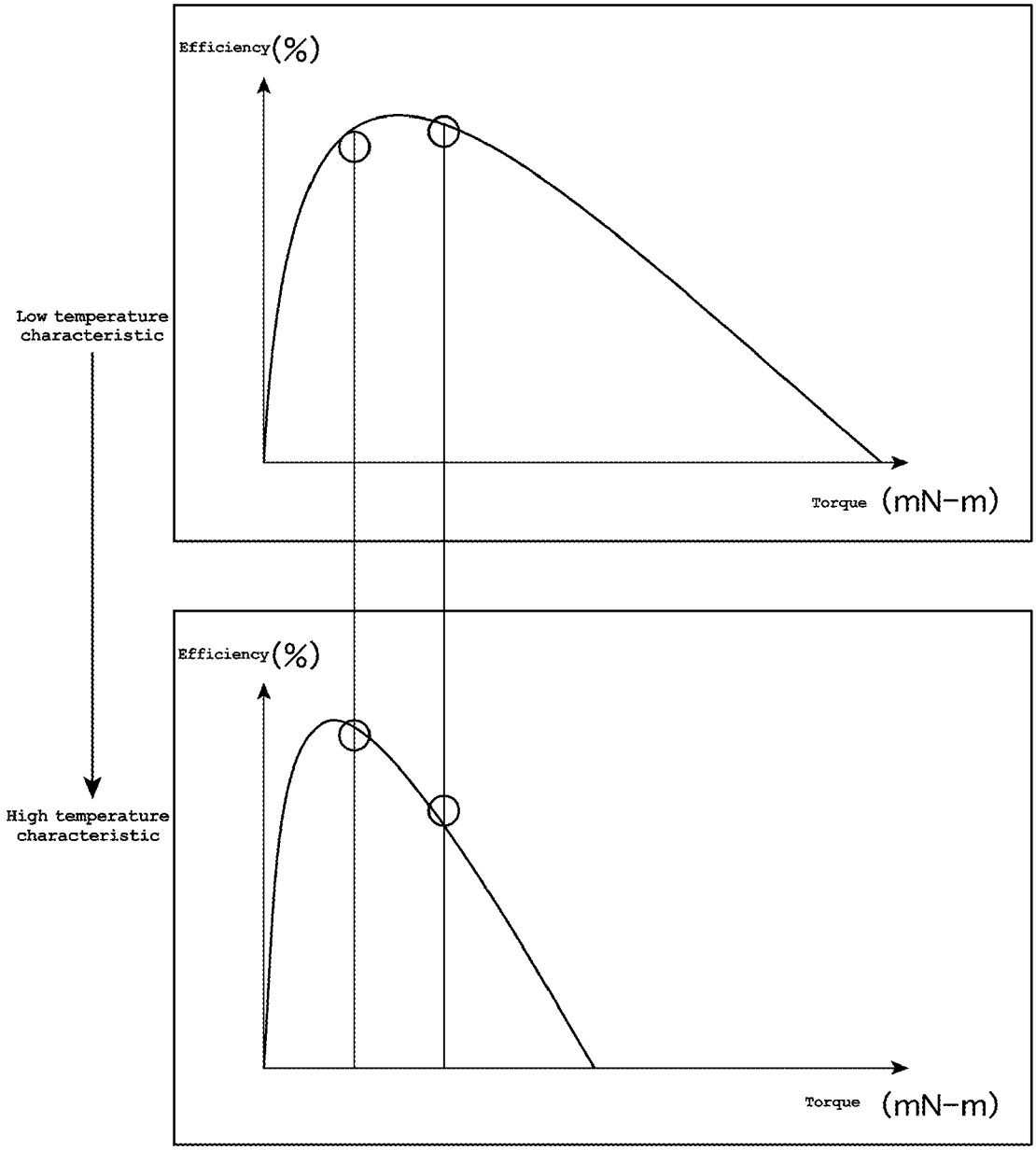

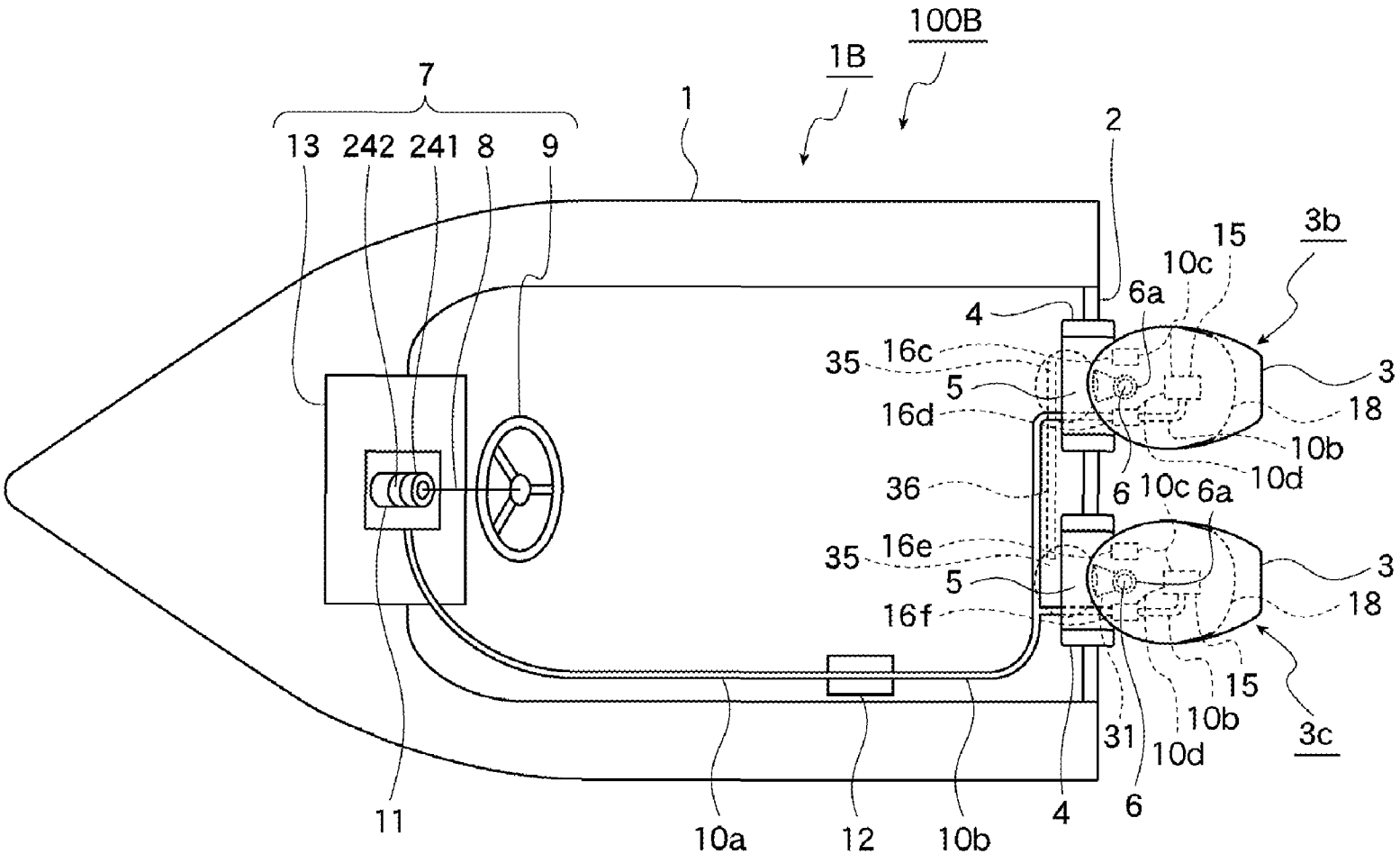
[FIG. 10]

[FIG. 11]
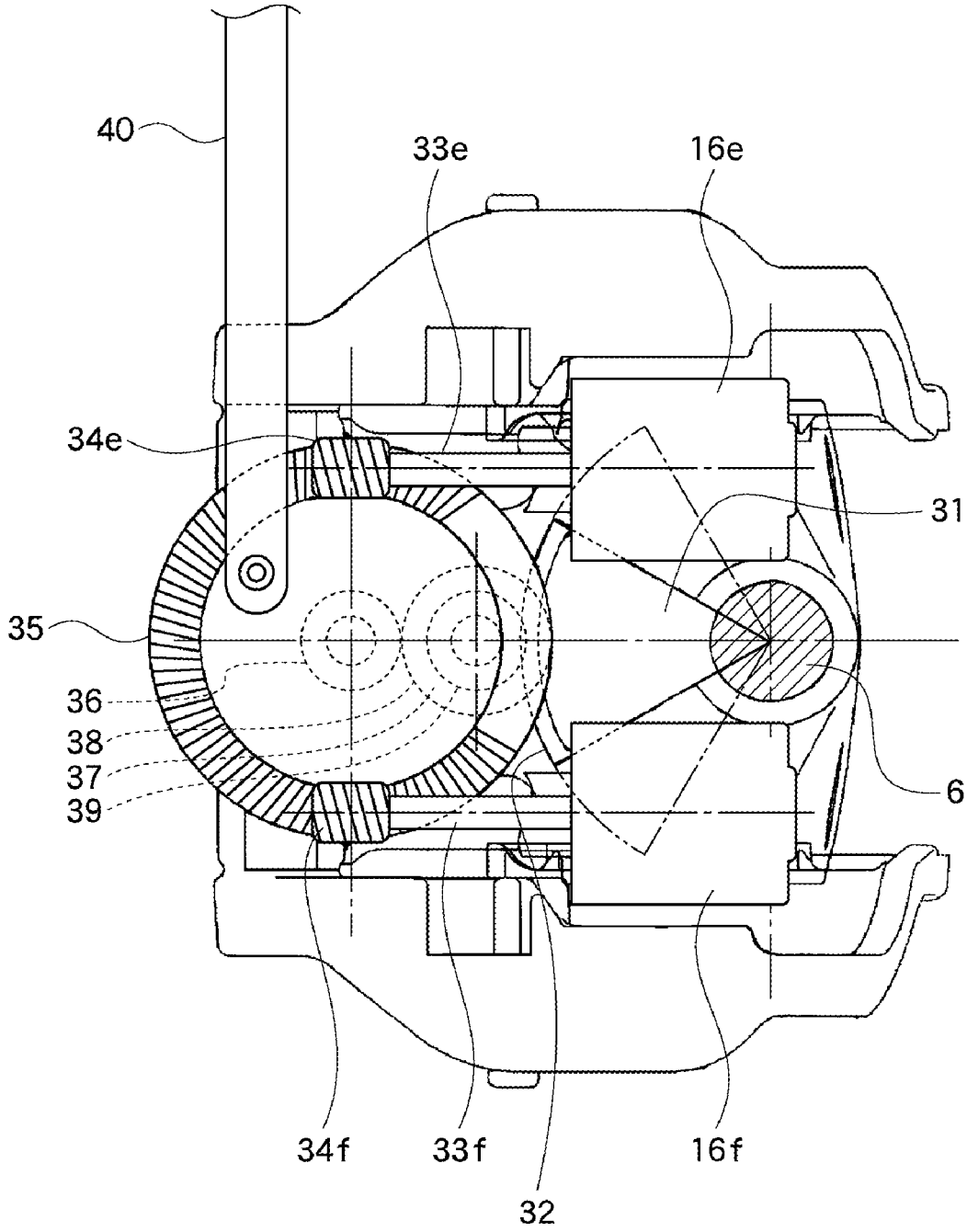

[FIG. 12]
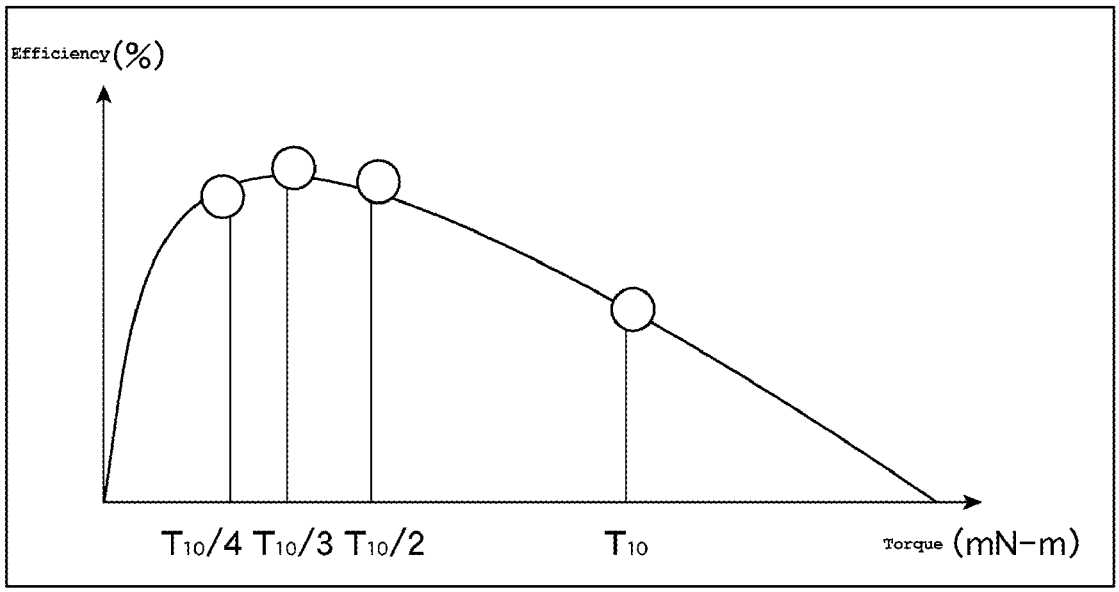

BOAT STEERING SYSTEM

CROSS-REFERENCE TO RELATED APPLICATIONS

The present application is based on and claims priority under 35 U.S.C. § 119 to Japanese Patent Application Serial Nos. 2006-245970, filed on Sep. 11, 2006, and 2006-315303, filed Nov. 22, 2006. The entire contents of each of these priority applications are expressly incorporated by reference herein.

BACKGROUND OF THE INVENTION

1. Field of the Invention

The present invention relates to a boat steering device and system.

2. Description of the Related Art

Outboard motors typically include an internal combustion engine that drives a propulsion propeller. Such motors are provided on the outside of a boat hull, and a steering motor usually is provided for horizontally rotating the outboard motor. For example, in Japanese Patent No. 2959044, a steering motor is provided to a connecting part between the hull and the outboard motor. A boat propulsion unit actuator connected by a signal cable to a steering wheel adjacent an operator's seat. A rotation angle sensor is provided on the steering wheel, and the steering motor operates according to the rotational direction and the rotation angle of the steering wheel as detected by the rotation angle sensor in order to steer the outboard motor.

A force necessary for steering an outboard motor varies continuously depending on certain conditions such as the speed of the boat, the rotation angle and the steering speed of the outboard motor, the relationship between the rotational direction of a propeller of the outboard motor and the steering direction of the outboard motor, and the boat weight. External forces such as waves and wind are also relevant. Therefore, the amount of torque necessary for the steering motor to steer the outboard motor varies continuously.

However, the device of Japanese Patent No. 2959044 does not contemplate adjusting the amount of torque generated by the steering motor. Also, the efficiency of a motor generally decreases depending on the increase of the amount of torque. Therefore, there is a problem that the efficiency of the steering motor decreases when the amount of torque increases.

Further, the amount of torque generation of the steering motor also varies according to changes in conditions of the motor itself such as the temperature of the motor. Consequently, there is a problem that the efficiency of the steering motor decreases with changing conditions.

SUMMARY OF THE INVENTION

Accordingly, there is a need in the art for a boat steering device for rotating a steering motor with high efficiency even when there is a change in certain conditions such as the cruising condition of the boat, the steering condition of the outboard motor, and the steering motor itself.

In accordance with one embodiment, the present invention provides a boat comprising a hull, a propulsion unit supported on the hull by a steering shaft, a steering system, and a steering drive system. The steering system comprises a steering input device adapted to receive steering inputs from a boat operator. The steering input device is electrically connected to the steering drive system. The steering drive system comprises a plurality of steering motors adapted to rotate the propulsion unit about the steering shaft to steer the boat. A steering torque detector is adapted to detect the torque during steering. A controller has a storage portion configured to store motor data concerning each of the steering motors. A motor selector is adapted to select which of the steering motors is operated to effect steering in response to a steering input. The motor selector selects which of the steering motors is operated based at least in part on the steering torque detected by the steering torque detector and the motor data.

In one such embodiment, the motor selector selects a plurality of the steering motors when the steering torque is larger than a threshold value and selects a smaller number of the steering motors than the number of the plurality of the steering motors when the steering torque is smaller than the threshold value.

In another embodiment the steering torque detector comprises at least one of a steering condition detector for detecting a steering condition according to operation of the steering input device, a rotation sensor for detecting a rotational speed and a rotational direction of the steering input device, and an angle sensor for detecting a steering angle of the steering input device. The motor selector calculates an amount of torque based at least in part upon detection results of at least one of the steering condition detector, the rotation sensor, and the angle sensor.

In yet another embodiment, the steering condition detector is adapted to detect a steering direction, a steering angle, a steering speed of the steering input device, and a force applied to the propulsion unit. The steering condition detector further comprises a deflection detector for detecting a difference between a target steering angle according to the operation of the steering input device and a steering angle of a control surface.

In still another embodiment, the steering torque detector includes a cruising condition detection sensor for detecting at least one of a water line condition of the boat, weight, a trim angle, the number of the propulsion units provided on the hull, a position of each propulsion unit on the hull, the rotational direction and the rotational speed of a propulsion propeller provided to the boat propulsion unit, an inclination condition of a trim tab, a propulsion speed of the boat, a propulsive force of the propulsion unit, a cruising condition of the boat, an output condition of an internal combustion engine mounted in the propulsion unit, a shape of the propeller, a shape of the trim tab, and acceleration of the boat. The motor selector uses a detection result of the cruising condition detection sensor to calculate the amount of torque.

A further embodiment additionally comprises a temperature sensor for detecting a temperature of the steering motor. The motor selector selects which of the steering motors is operated based at least in part on a detection result of the temperature sensor. In one embodiment, the motor selector selects the steering motors one by one in ascending order of temperature when the temperature of the plurality of the steering motors differ from each other. In another embodiment, the motor selector selects the steering motors one by one in descending order of maximum torque in the motor data when the temperature of the plurality of the steering motors differ from each other.

In a yet further embodiment, the motor selector selects the steering motors one by one in ascending order of temperature when the steering torque is in a low torque range and selects the steering motors one by one in descending order of temperature when the steering torque is in a high torque range.

In still further embodiments a plurality of propulsion units are supported on the hull, and a connecting member connects each of the propulsion units so that they rotate together about respective steering shafts. A force generated by rotation of each of the steering motors is transmitted to all the propulsion units connected by the connecting member, and all the propulsion units are steered in the same direction.

In another embodiment, the present invention provides a method of steering a boat comprising a propulsion unit rotatably supported on a hull. The method comprises providing a steering input device electrically connected to a steering drive system. The steering drive system comprises a plurality of steering motors adapted to rotate the propulsion unit to steer the boat, a plurality of detectors, and a controller. The method further provides detecting a steering condition of the steering input device, detecting and/or calculating a steering torque necessary to rotate the propulsion unit to a desired position corresponding to the steering condition of the steering input device, detecting a motor condition of each of the steering motors, selecting which of the plurality of steering motors to operate to move the propulsion unit to the desired position, and operating one or more selected ones of the plurality of steering motors to move the propulsion unit to the desired position. Selecting which of the plurality of steering motors to operate comprises considering the steering torque and considering a motor condition of the steering motors.

BRIEF DESCRIPTION OF THE DRAWINGS

FIG. 1 is a schematic plan view of a boat using an embodiment of a boat steering device.

FIG. 2 is an enlarged view around a swivel shaft in the boat of FIG. 1.

FIG. 3 is a function block diagram of an embodiment of the boat steering device.

FIGS. 4(*a*) to 4(*e*) are charts of motor characteristic data and hull information data on the boat steering device.

FIG. 5 is a flowchart illustrating a specific procedure for steering in the boat.

FIG. 6 is a chart illustrating a principle for generating a basic value for selecting a steering motor in a motor selector of the boat steering device.

FIG. 7 is a chart illustrating a principle for generating a first correction value in the motor selector of the boat steering device.

FIG. 8A is a chart illustrating a principle for generating a second correction value in the motor selector of the boat steering device.

FIG. 8B is another chart illustrating a principle for generating the second correction value in the motor selector of the boat steering device.

FIG. 8C is yet another chart illustrating a principle for generating the second correction value in the motor selector of the boat steering device.

FIG. 9 is a chart illustrating a principle for generating a third correction value in the motor selector of the boat steering device.

FIG. 10 is a schematic plan view of another embodiment of a boat having a steering system.

FIG. 11 is an enlarged view around a swivel shaft in the boat of FIG. 10.

FIG. 12 is a chart illustrating a principle for generating a basic value for selecting the steering motor in the motor selector of the boat steering system.

DETAILED DESCRIPTION OF PREFERRED EMBODIMENTS

With initial reference to FIG. 1, a boat 1A using a boat steering device 100A is presented according to a first embodiment.

The illustrated boat 1A is a type of small boat and has a hull 1 and an outboard motor 3*a* as a propulsion unit provided on the outside of the hull 1. The outboard motor 3*a* gives propulsive force to the boat 1A by a propeller 14 (see FIG. 3) and changes the traveling direction of the boat 1A. A trim tab 17 for adjusting the posture of the hull 1 is provided to the outboard motor 3*a*.

An outboard motor body 3 of the outboard motor 3*a* is mounted on a stern board 2 housing an engine 18 for rotationally operating the propeller 14 (see FIG. 3) and forming the rear end (the right end of the drawing) of the hull 1 via a clamp bracket 4 and a swivel bracket 5 mounted on the clamp bracket 4.

The swivel bracket 5 preferably has a swivel bearing 6*a* extending in the vertical direction with respect to the sheet plane of FIG. 1. A swivel shaft 6 rotatably supported by the swivel bearing 6*a* is mounted on the outboard motor main body 3.

A steering assembly 7 is provided in front of an operator's seat of the hull 1. In the illustrated embodiment, the top end of a steering shaft 8 joins the center of a steering wheel 9 of the steering assembly 7. The bottom end of the steering shaft 8 is inserted in a steering controller 13 and rotatably supported. A rotation sensor 241 for detecting the rotational speed and the rotational direction of the steering shaft 8 around the steering shaft 8, an angle sensor 242 for detecting the steering angle of the steering shaft 8, a part of a steering condition detector 244 for detecting the steering direction, the steering angle, and the steering speed of the steering wheel 9, and an anti-torque motor 11 for giving response to the steering wheel 9 preferably are provided in the steering controller 13.

The steering controller 13 preferably is connected to a control unit 12 by a signal cable 10*a*, and the control unit 12 preferably is connected to an outboard motor side controller 15 provided on the outboard motor main body 3 by a signal cable 10*b*. The outboard motor side controller 15 is connected with steering motors 16*a*, 16*b* by signal cables 10*c*, 10*d* and outputs a pulse signal for operating the steering motors 16*a*, 16*b* according to the command of the control unit 12.

With next reference to FIG. 2, which is an enlarged view around the swivel shaft 6 in the boat 1A, a swivel gear 31 in a sectorial shape is fixed to the swivel shaft 6 with teeth 32 facing forward of the hull 1. The steering motors 16*a*, 16*b* preferably are disposed behind the swivel bracket 5, and worms 34*a* and 34*b* mounted on output shafts 33*a* and 33*b* of the steering motors 16*a*, 16*b* and a worm wheel 35 engaging with the worms 34*a* and 34*b* are provided. The two illustrated steering motors 16*a*, 16*b* are disposed in parallel with each other with the output shafts 33*a* and 33*b* facing the front. A small gear 36 is integrally fixed on the lower surface of the worm wheel 35. An upper gear 38 of a double intermediate gear 37 is engaged with the small gear 36, and the rotational speed of the worm wheel 35 is further reduced, so that the rotational force is transmitted to the swivel gear 31 in a sectorial shape via a lower gear 39 of the double intermediate gear 37. Of course, other embodiment may employ other structure, such as more or less steering motors, and different configurations of such motors.

With reference next to FIG. 3, a block diagram demonstrates function of an embodiment of a boat steering device 100A.

As shown in the drawing, the illustrated boat steering device 100A has: the steering device 7 having the steering wheel 9; the control unit 12; a steering torque detector 24 as the steering torque detection means; and a steering angle sensor 25. In addition, the steering device 7, the steering motors 16*a*, 16*b*, a motor selector 21, a ROM 22 (a read only memory as an auxiliary memory device), the steering torque detector 24, and the steering angle sensor 25 form a steering drive section 20.

In the steering drive section 20, the motor selector 21 selects the steering motors 16*a* and/or 16*b* to be used for steering according to the motor characteristics of the steering motors 16*a*, 16*b* and the amount of torque necessary for steering the outboard motor 3*a* in order to steer the outboard motor 3*a* according to the steering of the steering wheel 9.

The control unit 12 has at least one CPU (a central processing unit not shown in the drawing), uses a RAM (a random access memory as a main storage device not shown in the drawing) as a workspace, and preferably controls the whole operation of the boat steering system 100A according to an implemented program.

The control unit 12 has the motor selector 21 and the ROM 22 as shown in FIG. 3.

The motor selector 21 is based on a circuit composing the control unit 12 such as the CPU and the operation result of the program stored in the ROM 22. A program and data for controlling the operation of the steering drive section 20 preferably are stored in the ROM 22. Specifically, motor characteristic data 231, which includes data concerning the motor characteristics of the steering motors 16*a*, 16*b*, and correction data 232, which includes data concerning the steering condition and the cruising condition of the boat 1A and the temperature, which may affect the amount of torque of the steering motors 16*a*, 16*b*, preferably are stored respectively as a table.

FIGS. 4(*a*) to 4(*e*) are charts of the motor characteristic data 231 and the correction data 232 according to one embodiment. As shown in one of the drawings (see FIG. 4(*a*)), the motor characteristic data 231 is a table in which values of the motor efficiency in relation to the amount of torque of the steering motors 16*a*, 16*b* are numerically expressed. In addition, the correction data 232 is composed of: a first correction table 232*a* (see FIGS. 4(*b*) and 4(*c*) in the drawing) in which correction values of the motor efficiency according to a steering condition such as the steering speed, the steering direction, the steering angle, and so forth of the outboard motor 3*a* are expressed in a table; a second correction table 232*b* (see FIG. 4(*d*)) in which correction values of the motor efficiency according to a cruising condition such as the load, the trim angle, the cruising speed, and so forth of the boat 1A are expressed in a table; and a third correction table 232*c* (see FIG. 4(*e*)) in which correction values of the motor efficiency according to the temperatures of the steering motors 16*a*, 16*b* are expressed in a table.

As shown in FIG. 3, the motor selector 21 calculates the amount of torque necessary for steering the outboard motor 3*a* according to the detection result of the steering torque detector 24 and so forth in order to select the steering motor 16*a* and/or 16*b* to be used for steering the outboard motor 3*a* according to the calculated amount of torque, the motor characteristic data 231 stored in the ROM 22, and so forth.

The steering torque detector 24 preferably includes various types of sensors and detectors provided to the hull 1 and the outboard motor main body 3 and detects the steering torque necessary for steering the outboard motor 3*a*. The steering torque detector 24 detects information necessary for calculating the steering torque in the motor selector 21. In preferred embodiments, the information may be the steering torque itself or information that affects the steering torque. At least a part of the detection functions in the steering torque detector 24 may be achieved by calculating the program stored in the ROM 22 of the control unit 12 in the CPU, or by using a hardware logic (not shown in the drawing) provided in the control unit.

Specifically, in the illustrated embodiment the steering torque detector 24 has the rotation sensor 241, the angle sensor 242, a cruising condition detection sensor 243 for detecting a condition that affects the cruising of the boat 1A, and the steering condition detector 244. The cruising condition detection sensor 243 is composed of a water line sensor 243*a* for detecting the water line condition of the boat 1A, a weight sensor 243*b* for detecting the weight of the boat 1A, a trim angle sensor 243*c* for detecting the trim angle of the outboard motor 3*a*, a position sensor 243*d* for detecting the number of the outboard motor 3*a* provided and/or the position of the outboard motor 3*a* in relation to the stern board 2, a propeller rotation sensor 243*e* for detecting the rotational direction and the rotational speed of the propeller 14 provided to the outboard motor 3*a*, a trim tab angle sensor 243*f* for detecting the slope condition of the trim tab 17 provided to the outboard motor 3*a*, a speed sensor 243*g* for detecting the cruising speed of the boat 1A, an engine torque sensor 243*h* for detecting the propulsive force of the engine 18 mounted in the outboard motor 3*a*, a cruising condition sensor 243*i* for detecting the cruising condition of the boat 1A, an output sensor 243*j* for detecting the output condition of the engine 18 mounted in the outboard motor 3*a*, temperature sensors 243*k*1 and 243*k*2 for detecting the temperatures of the steering motors 16*a*, 16*b*, a propeller detector 243*l* for detecting the shape of the propeller 14, a trim tab detector 243*m* for detecting the shape of the trim tab, and an acceleration sensor 243*n* for detecting the acceleration of the boat 1A. The cruising condition detection sensor 243 may include a part of the above sensors and detectors 243*a* to 243*n* or include a sensor or detector other than the above sensors and detectors 243*a* to 243*n*. It is to be understood that other embodiments may employ only one, some, or all of the listed detectors, and additional detectors may also be relevant and used.

The steering condition detector 244 detects the steering condition according to operation of the steering device 7. In addition, the steering condition detector 244 preferably includes one or more of: a steering detector 2441 (the steering detection means) for detecting the steering direction, the steering angle, and the steering speed of the steering wheel 9; a load detector 2442 (the load detection means) for detecting the force applied to the outboard motor 3*a* (the control surface) such as water pressure; and a deflection detector 2443 (the deflection detection means) for detecting the deflection between the target steering angle corresponding to the operation of the steering wheel 9 and the steering angle of the control surface. The steering detector 2441 and the deflection detector 2443 are provided around the steering shaft 8 and form the steering device 7. Still other detectors may be relevant and may be employed.

In the illustrated embodiment, the steering angle sensor 25 is an angle sensor provided to the outboard motor main body 3 and detects the actual steering angle of the outboard motor 3*a*.

FIG. 5 is a flowchart illustrating a specific example procedure of steering in the boat steering device 100A in one embodiment. The specific procedure of steering will be hereinafter described with reference to the drawing.

The control unit 12 calculates the amount of torque necessary for steering and selects the steering motors 16*a* and/or 16*b* to be used for steering.

Specifically, when an operator steers the steering wheel 9, the angle sensor 242 or the steering condition detector 244 (including the steering detector 2441, the load detector 2442, and the deflection detector 2443) provided to the steering device 7 detects the operation angle of the steering shaft 8 (step S1). A detection signal of the angle sensor 242 or the steering condition detector 244 is supplied to the control unit 12.

The motor selector 21 calculates the steering angle of the outboard motor 3*a* according to the operation angle of the steering shaft 8 calculated in the step S1 (step S2).

The steering angle sensor 25 provided to the outboard motor 3*a* detects the current steering condition of the outboard motor 3*a* (step S3). The detection signal of the steering angle sensor 25 is supplied to the control unit 12. According to the detection signal, the motor selector 21 calculates the steering angle of the outboard motor 3*a*. The calculated steering angle is used as a correction value to improve the numerical precision for calculating the amount of torque, which will be described below.

A cruising condition detection sensor 24 provided to the hull 1 detects the cruising condition of the boat 1A (step S4). The detection signal of the cruising condition detection sensor 24 is supplied to the control unit 12. According to the detection signal, the motor selector 21 calculates the cruising condition of the boat 1A.

The temperature sensors 243*k*1 and 243*k*2 provided to the steering motors 16*a*, 16*b* detect the temperatures of the steering motors 16*a*, 16*b* (step S5). The detection signals of the temperature sensors 243*k*1 and 243*k*2 are supplied to the control unit 12. According to the detection signals, the control unit 12 calculates the temperatures of the steering motors 16*a*, 16*b*.

The motor selector 21 selects the steering motors 16*a* and/or 16*b* to be used for steering the outboard motor 3*a* according to the value calculated in the steps S2 to S5. In other words, the motor selector 21 selects the number of the steering motors 16*a*, 16*b* to be used for steering and which of the steering motors 16*a*, 16*b* to be used for steering (step S6).

In some embodiments, a selection preferably is made according to one or more of a principle 1 to a principle 4 as described below.

Principle 1: Selection of Steering Motors 16*a* and/or 16*b* according to Motor Characteristic In some embodiments, the motor selector 21 generates a basic value (hereinafter referred to as "the basic value") for selecting the number of the steering motors 16*a*, 16*b* to be used for steering and which of the steering motors 16*a*, 16*b* to be used for steering according to the amount of torque calculated in step S2 and the motor efficiency of the steering motors 16*a*, 16*b* stored as the motor characteristic data 231.

FIG. 6 is a chart illustrating a principle for generating the basic value for the motor selector 21 to select the steering motor 16*a* and/or 16*b*.

In the drawing, the axis of abscissa indicates the amount of torque per steering motor 16*a* (or steering motor 16*b*), and the axis of ordinate indicates the motor efficiency per steering motor 16*a* (or steering motor 16*b*). The motor efficiency of each of the steering motors 16*a*, 16*b* varies according to the amount of torque as shown in the drawing.

When the amount of torque detected by the steering torque detector 24 at a specific time is small and in a range of high motor efficiency (for example, the amount of torque is T1 in FIG. 6), it is possible to achieve high-efficiency operation of the steering motors 16*a*, 16*b* by operating only one of the steering motors.

However, when the amount of torque detected by the steering torque detector 24 at a specific time is large (for example, the amount of torque is T21 in FIG. 6), if only one of the steering motors 16*a*, 16*b* is operated, the motor efficiency is low, the efficiency of the steering motor 16*a* or 16*b* is low, and the power consumption unnecessarily increases.

When the amount of torque is large, if the two steering motors 16*a*, 16*b* are operated at the same time, the amount of torque per steering motor is halved (for example, T22 in FIG. 6). Therefore, the motor efficiency increases. As a result, the efficiency of the steering motors 16*a*, 16*b* is enhanced, and the power consumption can be reduced.

When the amount of torque detected by the steering torque detector 24 at a specific time is extremely small, if the two steering motors 16*a*, 16*b* are operated at the same time, the amount of torque of each of the steering motors 16*a*, 16*b* is halved (for example, the amount of torque is T31 in FIG. 6). Therefore, the motor efficiency decreases. In this case, if only one steering motor 16*a* (or the steering motor 16*b*) is operated, the amount of torque is doubled (for example, T32 in FIG. 6). Therefore, the motor efficiency increases. As a result, the efficiency of the steering motor 16*a* (or of the steering motor 16*b*) is enhanced, and the power consumption can be reduced.

The motor selector 21 generates the basic value according to the above principles. Specifically, the motor selector 21 generates the basic value for operating the steering motors 16*a*, 16*b* according to at least one of procedures (1-1) to (1-2) below by comparing the detection signal detected by the rotation sensor 241 and the motor characteristic data 231 stored in the ROM 22. According to procedure (1-1), when the amount of torque detected by the steering torque detector 24 is large, both steering motors 16*a*, 16*b* are operated. In procedure (1-2), when the amount of torque detected by the steering torque detector 24 is small, only one of the steering motors 16*a*, 16*b* is operated.

According to procedures (1-1) and (1-2) above, a plurality of the steering motors 16*a*, 16*b* is selected when the steering torque is at a specific value or larger (for example, at the torque amount Tα in FIG. 6 where the motor efficiency is at a value half (25%) of the maximum value (50%)), and only one of the steering motors 16*a*, 16*b* is selected when the steering torque is lower than the specific value. As a result, it is possible that the number of motors to be rotated when the amount of torque necessary for steering is small is minimized.

Principle 2: Correction of Motor Characteristic according to Steering Condition of Boat 1A In some embodiments, the motor selector 21 generates a value for correcting the basic value generated in the step S2 according to the rotational speed, the rotational direction, and the steering angle of the steering shaft 8 as calculated in the step S3 (hereinafter referred to as "the first correction value").

FIG. 7 is a chart illustrating a principle for generating the first correction value in the motor selector 21. In this drawing, the direction of the axis of abscissa indicates the steering angle of the outboard motor 3*a*, and the direction of the axis of ordinate indicates the steering load of the outboard motor 3*a*. The steering torque is increased generally in proportion with the steering speed at a time when the outboard motor 3*a* is steered as shown in the drawing. The steering torque is increased generally in proportion with the amount of the steering speed.

Though not depicted in the drawing, the amount of torque necessary for steering the outboard motor 3*a* is small when the rotational direction of the propeller 14 agrees with the steering direction due to the influence of the counter torque generated by the propeller 14 rotating, and the amount of torque necessary for steering the outboard motor 3*a* is large when the rotational direction and the steering direction conflict.

In the first embodiment, the motor selector 21 obtains the first correction value according to first correction data 232*a* stored in the ROM 22. Specifically, the motor selector 21 generates the first correction value by comparing the detection signals of the rotation sensor 241 and the angle sensor 242 with the first correction data 232*a*.

The first correction value corrects the basic value in the direction for operating the steering motors 16*a*, 16*b* according to at least one of procedures (2-1) to (2-3) below. In procedure (2-1), the number of the steering motors 16*a*, 16*b* to be operated is increased as the steering angle is larger. In procedure (2-2), the number of the steering motors 16*a*, 16*b* to be operated is increased as the steering speed is higher. In procedure (2-3), the number of the steering motors 16*a*, 16*b* to be operated is increased or decreased according to the rotational direction of the propeller 14 and the steering direction.

The detection result of at least one of the rotation sensor and the angle sensor is used by the motor selector 21 to calculate the amount of torque. In addition, the steering condition of the outboard motor 3*a* is detected according to the operation of the steering device 7, and the detection signal is used to calculate the amount of torque necessary for steering the outboard motor 3*a*. As a result, it is possible to calculate the amount of torque by reflecting the steering condition of the outboard motor 3*a*.

Principle 3: Correction of Motor Characteristic according to Cruising Condition of Boat 1A In another embodiment, the motor selector 21 generates a value for correcting the basic value generated in the step S2 according to the cruising condition of the boat 1A calculated in the step S4 (hereinafter referred to as "the second correction value").

FIGS. 8A to 8C are charts illustrating a principle for generating the second correction value in the motor selector 21. In this drawing, the direction of the axis of abscissa indicates the steering angle of the outboard motor 3*a*, and the direction of the axis of ordinate indicates the steering load of the outboard motor 3*a*. As shown in the drawings, the steering torque for steering the outboard motor 3*a* is increased generally in proportion with the amount of the steering angle of the outboard motor 3*a*. However, even if the steering angle is the same, the amount of the necessary steering torque varies according to the cruising condition of the boat 1A.

For example, the steering load becomes larger as acceleration or deceleration of the boat 1A becomes larger as shown in FIG. 8A, and the amount of torque necessary for steering the outboard motor 3*a* becomes larger. Especially, the amount of torque necessary for steering the outboard motor 3*a* is increased instantly and abruptly at a time of a sudden acceleration or a sudden deceleration.

Similarly, the steering load of the outboard motor 3*a* becomes larger as the speed of the boat 1A becomes higher, and the steering load of the outboard motor 3*a* becomes larger as the engine speed of the outboard motor 3*a* becomes higher and the propulsive force becomes larger. Accordingly, the amount of torque necessary for steering becomes larger in both cases. In addition, the steering load of the outboard motor 3*a* becomes larger as the size of blades of the propeller 14 provided to the outboard motor 3*a* becomes larger, and the amount of torque necessary for steering becomes larger.

As shown in FIG. 8B, the steering load becomes larger as the load corresponding to the increase of the number of passengers, the loaded cargo, and the supplied fuel becomes larger, and the steering load becomes larger as the weight of the outboard motor 3*a* provided becomes larger, so that the amount of torque necessary for steering the outboard motor 3*a* becomes larger in both cases. Similarly, the steering load becomes larger as the trim angle becomes smaller (on the side of "IN"), and the amount of torque necessary for steering the outboard motor 3*a* becomes larger. The amount of torque necessary for steering the outboard motor 3*a* becomes larger as the number of the outboard motors 3*a* provided to the boat 1A is increased.

When a plurality of outboard motors are provided to the boat A1 (see, for example, FIG. 10), the underwater portion of an outboard motor, which is located on the inner side of a turn, is increased due to the roll of the boat 1A at a time of the turn of the boat 1A. Therefore, the steering load becomes larger than that of an outboard motor that is located on the outer side of the turn, as shown in FIG. 8C, so that the amount of torque necessary for steering becomes larger.

The motor selector 21 preferably obtains the second correction value according to second correction data 232*b* stored in the ROM 22. Specifically, the motor selector 21 obtains the second correction value by comparing the detection signal of the cruising condition detection sensor 243 with the second correction data 232*b* in the ROM 22.

More specifically, the second correction value corrects the basic value in the direction for operating the steering motors 16*a*, 16*b* according to at least one of procedures (3-1) to (3-4) below. In procedure (3-1), the number of steering motors 16*a*, 16*b* to be operated is increased as the cruising speed of the boat 1A is higher and the necessary steering torque is larger. In procedure (3-2), the number of steering motors 16*a*, 16*b* to be operated is increased as the trim angle is smaller and the necessary steering torque is larger. In procedure (3-3), the number of steering motors 16*a*, 16*b* to be operated is decreased in a state of an excessively low speed. In procedure (3-4), the number of steering motors 16*a*, 16*b* to be operated is increased at a time of sudden acceleration or sudden deceleration.

The detection result of the cruising condition detection sensor 243 is used to calculate the amount of torque considered according to the procedures (3-1) to (3-4) above. In addition, the detection result of the cruising condition that may change the speed of the boat 1A and the degree of acceleration or deceleration is used to calculate the amount of torque. As a result, it is possible to calculate the amount of torque by reflecting the change in the cruising condition.

Principle 4: Correction of Motor Characteristic according to Temperature

In some embodiments, the motor selector 21 generates a value for correcting the basic value generated in the step S2 according to the temperatures of the steering motors 16*a*, 16*b* calculated in the step S5 (hereinafter referred to as "the third correction value").

FIG. 9 is a chart illustrating a principle for generating the third correction value in the motor selector 21. In the drawing, the direction of the axis of abscissa indicates the amount of torque of the steering motors 16*a*, 16*b*, and the direction of the axis of ordinate indicates the motor efficiency of the steering motors 16*a*, 16*b*. The motor characteristic of the steering motors, 16*a*, 16*b* varies according to a temperature change as shown in the drawing. Specifically, the maximum amount of torque output according to the increase of the temperatures of the steering motors 16*a*, 16*b* becomes smaller, and the value of the amount of torque for realizing optimum motor efficiency becomes smaller.

In the embodiment, the motor selector 21 obtains the third correction value according to third correction data 232*c* stored in the ROM 22. Specifically, the motor selector 21 generates the third correction value by comparing the detection signals of the temperature sensors 243*k*1 and 243*k*2 with the third correction data 232*c* stored in the ROM 22.

The third correction value corrects the basic value in the direction for operating the steering motors 16*a*, 16*b* according to at least one of procedures (4-1) to (4-4) below. In procedure (4-1), the steering motor 16*a*, 16*b* having the lower temperature as detected by the temperature sensors 243*k*1 and 243*k*2 is used for steering with precedence. In procedure (4-2), the temperatures detected by the temperature sensors 243*k*1 and 243*k*2 and the data of the motor characteristic data 231 are compared, and one having the larger maximum torque is used for steering with precedence. In procedure (4-3), if the amount of torque of the basic value is larger (namely, in the high torque range), the steering motor 16*a*, 16*b* having the lower temperature is used for steering with precedence. If the amount of torque of the basic value is smaller (namely, in the low torque range), the steering motor 16*a*, 16*b* having the higher temperature is used for steering with precedence. In procedure (4-4), when the amount of torque of the basic value is output, the number of the steering motors 16*a*, 16*b* for minimizing the amount of heat generation is selected. The amount of heat generation of the steering motors 16*a*, 16*b* is calculated, for example, with a basic equation of heat generation ($Q=I^2R$, where Q is calorific value (cal), I is electric current (A), and R is resistance (Ω)) by using the amount of an electric current supplied to the steering motors 16*a*, 16*b*.

The detection results of the temperature sensors 243*k*1 and 243*k*2 are used to calculate the amount of torque according to the procedures (4-1) to (4-4) above. In addition, the temperatures of the steering motors 16*a*, 16*b*, which greatly change the motor characteristic, are used to calculate the amount of torque. As a result, it is possible to calculate the amount of torque by reflecting the temperatures of the steering motors 16*a*, 16*b*.

According to procedure (4-1) above, the steering motors 16*a*, 16*b* are selected one by one in ascending order of temperature. As a result, it is possible to rank the precedence at which the steering motors 16*a*, 16*b* to be used for steering are selected from a plurality of the steering motors 16*a*, 16*b* according to the amount of torque generated.

According to procedure (4-2) above, the steering motors 16*a*, 16*b* are selected one by one in descending order of maximum torque in the motor characteristic data 231. As a result, it is possible to rank the precedence of when the steering motors 16*a*, 16*b* are selected from a plurality of the steering motors 16*a*, 16*b* according to the amount of torque generated.

As for the steering motors 16*a*, 16*b* used for steering, the steering motor 16*a*, 16*b* having the lower temperature is selected if the steering torque is in the high torque range, and the steering motor 16*a*, 16*b* having the higher temperature is selected if the steering torque is in the low torque range according to the procedure (4-3) above. As a result, it is possible to rank the precedence of when the steering motors 16*a*, 16*b* are selected from a plurality of the steering motors 16*a*, 16*b* according to the amount of torque necessary for steering the outboard motor 3*a* and the temperature of the motor.

In a preferred embodiment, the motor selector 21 corrects the basic value, generated according to the principle 1, based on one or more of the first to third correction values of the principles 2 to 4 in order to select the steering motor 16*a* and/or 16*b* to be used for steering the outboard motor 3*a* as described above. The correction is made by adding the first to third correction values to the basic value or by multiplying the basic value by the first to third correction values. In addition, the motor selector 21 preferably selects the steering motors 16*a* and/or 16*b* by using the value of the steering angle calculated in the step S3 as a correction value.

The motor selector 21 operates the steering motors 16*a* and/or 16*b* selected in the step S6 and steers the outboard motor 3*a* (step S7).

In the illustrated embodiment, the output shafts 33*a* and 33*b* of the steering motors 16*a*, 16*b* rotate when the pulse signal is output from the outboard motor side controller 15 according to the command signal from the motor selector 21. The worm wheel 35 is rotated by rotations of the output shafts 33*a* and 33*b*, and the rotation of the worm wheel 35 is transmitted to the upper gear 38 of the double intermediate gear 37 via the small gear 36 and rotates the swivel gear 31 engaged with the lower gear 39. The swivel shaft 6 is rotated by the rotation of the swivel gear 31. As the swivel shaft 6 is rotated, the outboard motor main body 3 rotates in a horizontal plane with the swivel shaft 6 at the center. It is to be understood that other structural configurations of steering motors, shafts, and the like may be employed, and that more than two motors may also be used in other embodiments.

In the embodiment above, the steering drive section 20 of the boat steering device 100A has: a plurality of the steering motors 16*a*, 16*b* provided to the swivel shaft 6 rotated according to the steering command of the steering device 7 so as to steer the outboard motor 3*a*; the steering torque detector 24 for detecting the steering torque during steering; the ROM 22 storing the motor characteristic data 231 on each of the steering motors 16*a*, 16*b*; and the motor selector 21 for selecting the steering motor 16*a* and/or 16*b* to be used for steering the outboard motor 3*a* from a plurality of the steering motors 16*a*, 16*b*. As a result, it is possible to change the number of the steering motors 16*a*, 16*b* to be rotated according to the change in the amount of torque necessary for steering the outboard motor 3*a*.

In the first embodiment, the motor selector 21 selects one or a plurality of the steering motors 16*a*, 16*b* to be operated from the two steering motors 16*a*, 16*b* according to the steering torque detected by the steering torque detector 24 and the motor characteristic data 231. Consequently, it is possible to decide the number of the steering motors 16*a*, 16*b* to be used for steering the outboard motor 3*a* so as to obtain the amount of torque for rotations with high motor efficiency. As a result, the number of the steering motors 16*a*, 16*b* to be used for steering the outboard motor 3*a* is changed according to a change in a condition of the boat 1A and the outboard motor 3*a* or a change in a condition of the steering motors 16*a*, 16*b* themselves.

FIG. 10 is a schematic plan view of a boat using a boat steering device 100B according to another embodiment.

A boat 1B in this embodiment is substantially the same as the boat 1A in the first embodiment, except that two outboard motors 3*b* and 3*c* are provided. As shown in the drawing, two steering motors 16*c* and 16*d* are provided to the outboard motor 3*b*, and two steering motors 16*e* and 16*f* are provided to the outboard motor 3*c*, respectively.

FIG. 11 is an enlarged view around the swivel shaft 6 on the side of the outboard motor 3*c* of the boat 1B in this embodiment. As shown, one end of a shaft 40 as a connecting member is pivotably supported by the worm wheel 35 as shown in the drawing. Similarly, the other end of the shaft 40 is pivotably supported by the worm wheel of the other outboard motor 3*b* (not shown in the drawing).

Other components preferably are substantially the same as those in the embodiments discussed above.

A plurality of the outboard motors 3*b* and 3*c* provided to the boat 1B are connected by the shaft 40 in the illustrated embodiment. Therefore, the force generated by rotations of the steering motors 16*c*, 16*d* on the side of one outboard motor 3*c* and the steering motors 16*e*, 16*f* on the side of the other outboard motor 3*b* is transmitted to both the outboard motors 3*b*, 3*c* by the shaft 40. As a result, the force generated by rotation of each of the steering motors 16*c*, 16*d*, 16*e*, and 16*f* is transmitted to both the outboard motors 3*b* and 3*c*. Consequently, both the outboard motors 3*b* and 3*c* are steered in the same direction.

Force generated by rotations of the steering motors 16*e*, 16*f*, 16*g*, and 16*h* preferably is given to both outboard motors 3*b* and 3*c* equally. As a result, the steering directions, the steering speeds, and the steering angles of both the outboard motors 3*b* and 3*c* are respectively equal to each other. Accordingly, unbalanced steering of the boat 1B that can sometimes occur with a plurality of outboard motors 3*b* and 3*c* can be prevented. For example, when the propeller 14 of one outboard motor 3*c* rotates in the direction of the right turn and the propeller 14 of the other outboard motor 3*b* rotates in the direction of the left turn, the counter torques of both the propellers 14 and 14 (see the principle 2 above) are in the opposite directions. For example, when the outboard motors 3*b* and 3*c* are steered to the right, an unbalanced force is always generated so that the counter torque of one outboard motor 3*c* becomes small, while the counter torque of the other outboard motor 3*b* becomes large. In contrast, the force generated by the rotation of each of the steering motors 16*c*, 16*d*, 16*e*, and 16*f* is transmitted equally to both the outboard motors 3*b* and 3*c* by the shaft 40. This makes it easy to control each of the steering motors 16*c*, 16*d*, 16*e*, and 16*f*. In addition, unbalanced steering can be prevented.

When principles (1-1) and (1-2) of the first embodiment are applied in the present embodiment, one to four motors are selected from the four steering motors 16*c*, 16*d*, 16*e*, and 16*f* and operated. For example, when the amount of torque necessary for steering the outboard motors 3*b* and 3*c* is assumed to be $T_{10}$ as shown in the chart of FIG. 12, the steering torque with one steering motor 16*c* to be operated is $T_{10}$. The steering torque of each motor with two steering motors 16*c*; 16*d* being operated is $T_{10}/2$; the steering torque of each motor with three steering motors 16*c*, 16*d*, and 16*e* being operated is $T_{10}/3$; and the steering torque of each motor with four steering motors 16*c*, 16*d*, 16*e*, and 16*f* being operated is $T_{10}/4$. In this embodiment, it is possible to achieve high-efficiency operation of the steering motors 16*c*, 16*d*, 16*e*, and 16*f* by selecting one of the above operation methods, which results in the highest motor efficiency (In FIG. 12, the case of $T_{10}/3$ where three steering motors 16*c*, 16*d*, and 16*e* are operated).

The motor selector 21 preferably selects the steering motors 16*a* to 16*f* to be used for steering by using the motor characteristic data 231 formed as the table in the embodiments above. However, the present invention is not limited to these embodiments, a selection of the steering motors 16*a* to 16*f* to be used for steering can be made by a calculation for obtaining the motor efficiency. For example, it is possible to select a steering motor and a combination of steering motors for realizing the highest motor efficiency by obtaining the motor efficiency with the following equation.

Motor output (*W*)=Torque (*mN*–*m*)×Rotational speed (*r*/min)×Constant

Motor efficiency (%)={Motor output (*W*)/(Input voltage (*V*)×Current consumption (*A*))}×Constant The boat steering devices 100A and 100B are used for the boats 1A and 1B provided with one or two outboard motors in the embodiments above. However, the present invention is not limited to these embodiments, the boat steering device of the present invention may be applicable to a boat provided with three outboard motors or more.

The embodiments above are intended to show examples of the present invention, but not intended to indicate that the present invention is limited to these embodiments. For example, the illustrated embodiments employ outboard motors having a propeller. In other embodiments, other types and configurations of propulsion units may employ principles as discussed herein. For example, an outboard motor driving an impeller or multiple propellers, a stern drive, and the like. Further, principles discussed herein can be used in connection with one or more control surfaces.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A boat comprising a hull, a propulsion unit supported on the hull by a steering shaft, and a steering system, the steering system comprising a steering input device adapted to receive steering inputs from a boat operator, and a steering drive system, the steering input device electrically connected to the steering drive system, the steering drive system comprising a plurality of steering motors adapted to rotate the propulsion unit about the steering shaft to steer the boat, a steering torque detector adapted to detect the torque during steering, and a controller, the controller having a storage portion configured to store motor data concerning each of the steering motors, and a motor selector adapted to select which of the steering motors is operated to effect steering in response to a steering input, wherein the motor selector selects which of the steering motors is operated based at least in part on the steering torque detected by the steering torque detector and the motor data.

2. The boat according to claim 1, wherein the motor selector selects a plurality of the steering motors when the steering torque is larger than a threshold value and selects a smaller number of the steering motors than the number of the plurality of the steering motors when the steering torque is smaller than the threshold value.

3. The boat according to claim 2, wherein the steering torque detector comprises at least one of a steering condition detector for detecting a steering condition according to operation of the steering input device, a rotation sensor for detecting a rotational speed and a rotational direction of the steering input device, and an angle sensor for detecting a steering angle of the steering input device; and the motor selector calculates an amount of torque based at least in part upon detection results of at least one of the steering condition detector, the rotation sensor, and the angle sensor.

4. The boat according to claim 3, wherein the steering condition detector is adapted to detect a steering direction, a steering angle, a steering speed of the steering input device, and a force applied to the propulsion unit, the steering condition detector further comprising a deflection detector for detecting a difference between a target steering angle according to the operation of the steering input device and a steering angle of a control surface.

5. The boat according to claim 4, wherein the steering torque detector includes a cruising condition detection sensor for detecting at least one of a water line condition of the boat, weight, a trim angle, the number of the propulsion units provided on the hull, a position of each propulsion unit on the hull, the rotational direction and the rotational speed of a propulsion propeller provided to the boat propulsion unit, an inclination condition of a trim tab, a propulsion speed of the boat, a propulsive force of the propulsion unit, a cruising condition of the boat, an output condition of an internal combustion engine mounted in the propulsion unit, a shape of the propeller, a shape of the trim tab, and acceleration of the boat, wherein the motor selector uses a detection result of the cruising condition detection sensor to calculate the amount of torque.

6. The boat according to claim 5 further comprising a temperature sensor for detecting a temperature of the steering motor, wherein the motor selector selects which of the steering motors is operated based at least in part on a detection result of the temperature sensor.

7. The boat according to claim 6, wherein the motor selector selects the steering motors one by one in ascending order of temperature when the temperature of the plurality of the steering motors differ from each other.

8. The boat according to claim 7, wherein the motor selector selects the steering motors one by one in descending order of maximum torque in the motor data when the temperature of the plurality of the steering motors differ from each other.

9. The boat according to claim 8, wherein the motor selector selects the steering motors one by one in ascending order of temperature when the steering torque is in a low torque range and selects the steering motors one by one in descending order of temperature when the steering torque is in a high torque range.

10. The boat according to claim 9, wherein a plurality of propulsion units are supported on the hull, and a connecting member connects each of the propulsion units so that they rotate together about respective steering shafts, wherein a force generated by rotation of each of the steering motors is transmitted to all the propulsion units connected by the connecting member, and all the propulsion units are steered in the same direction.

11. The boat according to claim 6, wherein a plurality of propulsion units are supported on the hull, and a connecting member connects each of the propulsion units so that they rotate together about respective steering shafts, wherein a force generated by rotation of each of the steering motors is transmitted to all the propulsion units connected by the connecting member, and all the propulsion units are steered in the same direction.

12. The boat according to claim 2, wherein the steering condition detector is adapted to detect a steering direction, a steering angle, a steering speed of the steering input device, and a force applied to the propulsion unit, the steering condition detector further comprising a deflection detector for detecting a difference between a target steering angle according to the operation of the steering input device and a steering angle of a control surface.

13. The boat according to claim 1, wherein the steering torque detector comprises at least one of a steering condition detector for detecting a steering condition according to operation of the steering input device, a rotation sensor for detecting a rotational speed and a rotational direction of the steering input device, and an angle sensor for detecting a steering angle of the steering input device; and the motor selector calculates an amount of torque based at least in part upon detection results of at least one of the steering condition detector, the rotation sensor, and the angle sensor.

14. The boat according to claim 2, wherein a plurality of propulsion units are supported on the hull, and a connecting member connects each of the propulsion units so that they rotate together about respective steering shafts, wherein a force generated by rotation of each of the steering motors is transmitted to all the propulsion units connected by the connecting member, and all the propulsion units are steered in the same direction.

15. The boat according to claim 1 further comprising a temperature sensor for detecting a temperature of the steering motor, wherein the motor selector selects which of the steering motors is operated based at least in part on a detection result of the temperature sensor.

16. The boat according to claim 15, wherein the motor selector selects the steering motors one by one in ascending order of temperature when the temperature of the plurality of the steering motors differ from each other.

17. A method of steering a boat comprising a propulsion unit rotatably supported on a hull, the method comprising providing a steering input device electrically connected to a steering drive system, the steering drive system comprising a plurality of steering motors adapted to rotate the propulsion unit to steer the boat, a plurality of detectors, and a controller, detecting a steering condition of the steering input device, detecting and/or calculating a steering torque necessary to rotate the propulsion unit to a desired position corresponding to the steering condition of the steering input device, detecting a motor condition of each of the steering motors, selecting which of the plurality of steering motors to operate to move the propulsion unit to the desired position, and operating one or more selected ones of the plurality of steering motors to move the propulsion unit to the desired position, wherein selecting which of the plurality of steering motors to operate comprises considering the steering torque and considering a motor condition of the steering motors.

18. A method as in claim 17, wherein the controller selects a plurality of steering motors when the steering torque is larger than a threshold value and selects a smaller number of steering motors than the number of the plurality of steering motors when the steering torque is smaller than the threshold value.

19. A method as in claim 17 further comprising detecting a temperature of each steering motor, and selecting which of the steering motors to operate based at least in part on the detected temperature.

20. A method as in claim 19 additionally comprising selecting the steering motors one by one in ascending order of temperature when the temperature of the plurality of the steering motors differ from each other.

* * * * *